When the stepping motor 142 is actually rotated to reach the aforementioned initial value of idling, the third comparator 140 issues an output, which resets the third flipflop 147. As the result, the third AND gate 150 is opened and the data from the fourth memory 136 are allowed to be fed to the output controller 141.

Since the fourth memory 136 keeps in storage, as described above, the data for compensation of the rotational position of the stepping motor 142 with the engine's rotational speed as a parameter, it feeds to the output controller 141 the output indicating either the amount of rotation of the stepping motor or the number of drive pulses required for compensation where the engine's rotational speed deviates from the prescribed rotational speed for idling.

Even when the degrees of opening of the choke valve and the throttle valve are adjusted by the operation of the stepping motor 142, no immediate change in the rotational speed is obtained because of the inertia of the engine, for example. In due consideration of this situation, it is desirable that the following control should be suspended for a certain length of time after a change has been made in the rotational position of the stepping motor.

Step S31 of FIG. 2 is intended to allow time for this suspension of the control. Until the time so prescribed for the suspended control elapses, the processing returns to Step S6 instead of processing to execute the compensation of the rotational angle of the stepping motor in Step S33.

In the apparatus of FIG. 1, similar allowance of time can be attained by controlling the operation timing of the output controller 141 and/or the third AND gate 150 with a proper timer or sequencer (not shown).

As the elapse of the prescribed time is sensed in Step S31, the timer for measuring the aforementioned prescribed time is cleared in Step S32 and the processing advances to Step S33. Then, the stepping motor is driven according to the data of the fourth memory 136 which has been read out in Step S30.

In the manner described above, transition from the cold state control to the idle operation is effected.

As is evident from the foregoing description, in the conventional mixture control apparatus for the carburetor, the transition from the cold region, past the home position, to the hot region or the idle operation region is carried out while the acceleration switch is on.

The open position of the throttle valve, therefore, is set at the initial value of idling in the hot region instead of being approximated to the lowest value near the home position. This special adaptation removes the possibility that, during the aforementioned transition, the degree of opening of the throttle valve will become so insufficient as to entail excessive decline of the rotational speed or total stop of the engine.

Thus, in the conventional mixture control apparatus for the carburetor, the rotational frequency of the idling operation can be notably stabilized because the direction and the quantity of the rotation of the stepping motor 142 are directly read out of the relevant memories according to the deviation of the rotational speed of the engine from the prescribed value and the rotational speed during the idling operation is controlled based on the data so read out.

Further because the degrees of opening of the throttle valve and the choke valve can be controlled by a monoaxial operation, the construction of the apparatus can be simplified and the cost of the apparatus can be proportionately lowered.

Optionally, the mixture control apparatus for the carburetor constructed as described above may be embodied in a form modified as indicated below.

(1) The initial setting of the U/D counter 143 is effected at the time that the home position switch is turned from its closed state to its opened state.

(2) The first memory 133 for cold starting is caused to memorize the degree of opening of the throttle valve by using, as a parameter therefor, at least either of the outputs from the inlet air temperature sensor 122 and the engine temperature sensor 123.

(3) The second memory 134 for warming is caused to memorize the degree of opening of the throttle valve by using, as parameters therefor, at least two of the outputs from the engine's rotational speed sensor 121, the inlet air temperature sensor 122, and the engine temperature sensor 123.

(4) The third memory 135 for hot starting is caused to memorize the degree of opening of the throttle valve by using, as a parameter, at least either of the outputs from the inlet air temperature sensor 122 and the engine temperature sensor 123.

(5) The sixth memory 138 for setting the initial value of idling is caused to memorize the degree of opening of the throttle valve by using, as a parameter therefor, at least either of the outputs from the inlet air temperature sensor 122 and the engine temperature sensor 123.

Also, the aforementioned sixth memory 138 is caused to memorize the degree of opening of the throttle valve by using, as parameters therefor, the rotational position of the stepping motor 142 and the data of the fourth memory 136 immediately before transition to the idle operation.

(6) The detection of the operation of the acceleration switch is substituted by the detection of the fact that the throttle lever is not meshed with the interlocking lever.

(7) The following two conditions may be adopted as the requisites for the transition from the cold region to the hot region.

(A) That the engine temperature should be higher than the prescribed value.

(B) That the ratio of increase of the engine's rotational speed should be higher than the prescribed value.

As described above, the conventional mixture control apparatus for the carburetor relies for switch of the control from the cold region to the hot region upon the boundary temperature between the cold and hot regions (or upon the ratio of increase of the engine's rotational speed).

Incidentally, the outputs from the sensors serving to detect the engine temperature and the engine's rotational speed are analog signals which do not always have high stability. Generally, such analog signals are in a fluctuating state. During the AD conversion of such outputs into digital values, therefore, the resultant digital values more often than not fluctuate when the aforementioned analog signals representing the outputs happen to fall near their respective threshold values.

The conventional mixture control apparatus for the carburetor which effects distinction between the cold state and the hot state based on a fixed threshold value, therefore, has a disadvantage that the stepping motor 142 will undergo hunting and, consequently, the degree

IGNITION TIMING CONTROL APPARATUS FOR AN INTERNAL COMBUSTION ENGINE

BACKGROUND OF THE INVENTION

The present invention relates to an ignition timing control apparatus for an internal combustion engine, and more particularly to an ignition timing control apparatus for an internal combustion engine suitable for controlling an ignition timing of an engine for a motor vehicle having exhaust gas purification means.

In the internal combustion engine for the motor vehicle, a negative pressure advancing device is arranged in a distributor and a negative pressure slightly upstream of a full close position of a throttle valve in an intake air path is detected so that an ignition timing is advanced in accordance with an operation condition of the engine represented by the detected negative pressure. It is intended to economize fuel and improve engine performance by advancing the ignition timing.

In recent years, in order to reduce noxious components exhausted from the engine of the motor vehicle having the negative pressure advancing device, the advancement of the ignition timing is suppressed under a particular operation condition. Under the particular operation condition, the ignition timing is retarded relative to an output timing so that a maximum combustion temperature is lowered and nitrogen oxide in the exhaust gas is reduced and an exhaust gas temperature is raised to promote oxidization of carbon monoxide and hydrocarbon. In this manner, the noxious components are reduced.

It has been proposed to allow the advancement of the ignition timing by the negative pressure advancing device when an engine is operated at a high speed gear ratio and forcibly suppress the operation of the negative pressure advancing device when the engine is operated at other than the high speed gear ratio.

In such an engine, a shift switch for detecting a fourth speed or a fifth speed is arranged in a transmission, and when the shift switch is actuated to indicate the fourth or fifth speed condition, the intake negative pressure supplied to the negative pressure advancing device of the distributor is prevented from being blocked. A similar arrangement may be used in an motor vehicle hov-ing an automatic transmission engine.

It has also been proposed to permit the advancement of the ignition timing by the negative pressure advancing device when an engine coolant temperature is below a predetermined temperature or when the engine is operated under a cool condition and forcibly suppress the operation of the negative pressure advancing device when the engine coolant temperature is above the predetermined temperature or when the engine is operated under a warm condition and a transmission gear is at other than the high speed gear position.

In such an engine, however, a load to the engine is not included in the condition to forcibly suppress the operation of the negative pressure advancing device. Accordingly, under a light load condition of the engine, surging occurs, which causes the deterioration of the operation performance of the motor vehicle and the increase of fuel consumption.

SUMMARY OF THE INVENTION

It is an object of the present invention to provide an ignition timing control apparatus of an internal combustion engine which forcibly suppresses the operation of the negative pressure advancing device under a light load condition of the engine.

In accordance with the present invention, the ignition timing control apparatus comprises negative pressure advancing means for controlling a governor advancing device arranged at a distributor in accordance with an operation condition of the engine to advance an ignition timing; gear position sensing means for producing a high speed gear position signal when a transmission gear is at a high speed gear position; temperature sensing means for producing a temperature signal when the engine is at least in a warm-up condition; load sensing means for producing a light load signal when the engine is operated under a light load condition; and means for permitting the control to the governor advancing device by the negative pressure advancing means when one of the high speed gear position signal, the temperature signal and the light load signal is produced and inhibiting the control to the governor advancing device by the negative pressure advancing means when none of the high speed gear position signal, the temperature signal and the light load signal is produced.

According to the present invention, the advancement control to the governor advancing device by the negative pressure advancing device is inhibited only when the transmission gear is at other than the high speed gear position, the engine temperature is above a predetermined temperature and the engine is operated under a high load condition, and the ignition timing is advanced by the negative pressure advancing device in accordance with the operation condition of the engine whenever the engine is operated under the light load condition.

DETAILED DESCRIPTION OF THE PREFERRED EMBODIMENT

Figure 1:
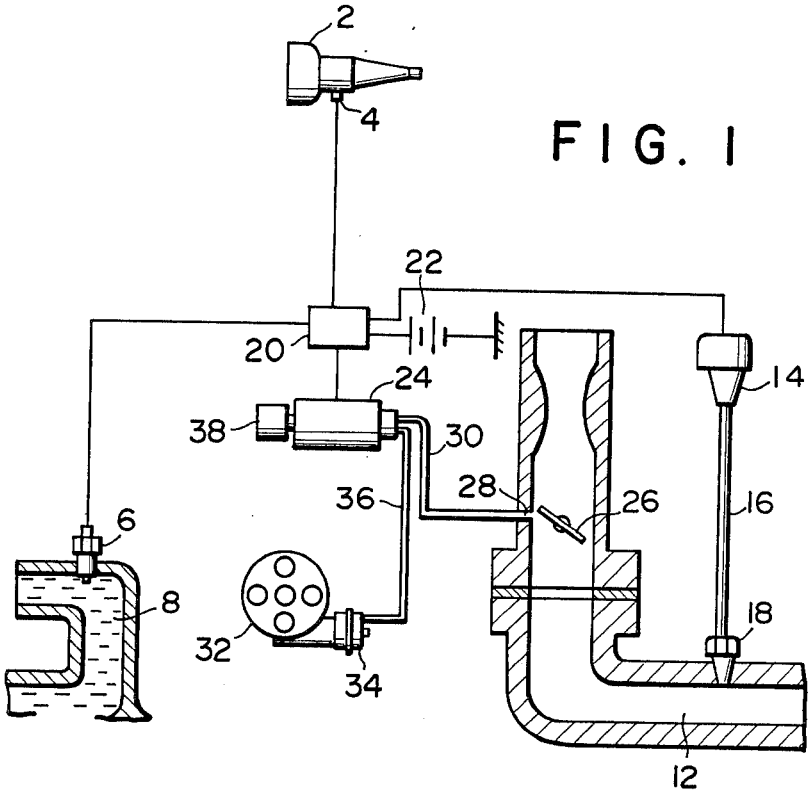
FIG. 1 shows one embodiment of an ignition timing control apparatus for an internal combustion engine of a motor vehicle in accordance with the present invention.

FIG. 1 shows a preferred embodiment of the present invention. A shift switch 4 for producing a high speed gear position signal when a transmission gear is at a high speed gear position is arranged at a transmission 2. In the case of a manual transmission, the shift switch 4 produces the high speed gear position signal when the gear is selected to a fourth or fifth speed, and in the case of an automatic transmission, the shift switch 4 produces the high speed gear position signal when the gear ratio is at a high gear ratio in a drive range or an overdrive range.

A coolant temperature switch 6 is provided as temperature sensing means for sensing a cool condition of the engine in which a temperature of the engine is below a predetermined temperature. The coolant temperature switch 6 senses the temperature of coolant 8 of the engine. It is deactuated when the engine is at a temperature suitable for a normal operation and actuated to produce the temperature signal when the engine is at a low temperature during a warm-up condition or at a high temperature which may cause overheat of the engine.

Figure 2:
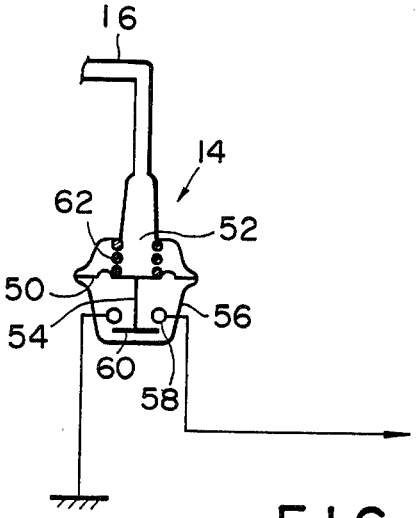
FIG. 2 shows a structure of a vacuum switch shown in FIG. 1.

A vacuum switch 14 for sensing the light load condition of the engine is provided in an intake manifold 12 downstream of a throttle valve 26. As shown in FIG. 2, the vacuum switch 14 has a pressure chamber 52 sectioned by a diaphragm 50, a movable contact 54 fixed to the diaphragm 50, a stationary contact 58 fixed to a switch case 56 and a compression spring 62 inserted in the pressure chamber 52 for normally biasing the diaphragm 50 downwardly as viewed in the drawing to keep a contact 60 in a released position. The pressure chamber 52 is connected to the intake manifold 12 through a negative pressure pipe 16 and an adaptor 18. Under the light load condition in which the negative pressure in the intake manifold 12 is high, the hihg negative pressure of the intake manifold 12 is introduced into the pressure chamber 52 of the vacuum switch 14. As a result, the movable contact 54 of the vacuum switch 12 is pulled upward against the force of the compression spring 62 and the contact 60 is made so that the light load condition is detected and the light load signal is produced.

Figure 3:
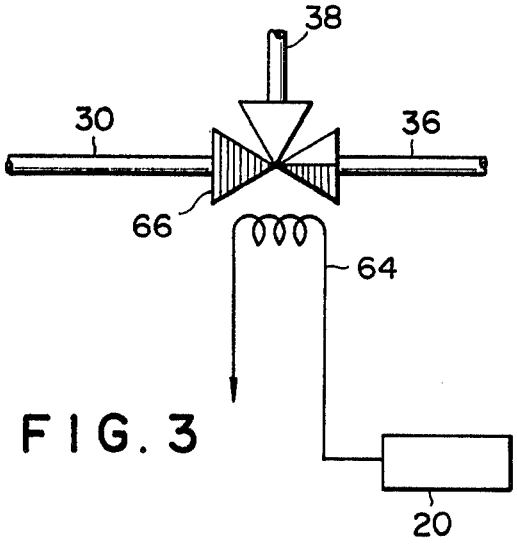
FIG. 3 shows a structure of a negative pressure switching solenoid valve shown in FIG. 1.

The shift switch 4, the coolant temperature switch 6 and the vacuum switch 14 are connected to a control circuit 20. When the signal from one of those switches is supplied to the control circuit 20, it connects a power supply 22 to a negative pressure switching solenoid value 24. As shown in FIG. 3, the negative pressure switching solenoid value 24 has an exciting coil 64 and a negative pressure switching value 66. When the power is supplied through the control circuit 20 to the coil 64 to excite the coil 64 and switch the negative pressure switching valve 66, a negative pressure pipe 30 connected to an advance port 28 formed slightly upstream of a fuel close position of the throttle valve 26 is communicated with a negative pressure pipe 36 connected to a negative pressure advancing device 34 which is arranged on a side of a distributor 32 to control the ignition timing in accordance with the operation condition of the engine. When the power is not supplied to the coil 64 through the control circuit 20, an air suction port 38 is communicated with the negative pressure pipe 36 so that air is supplied to the negative pressure advancing device 34.

Figure 4:
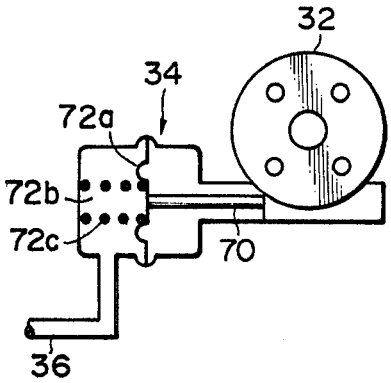
FIG. 4 shows a structure of a negative pressure control device shown in FIG. 1.

Referring to FIG. 4, the negative pressure advancing device 34 comprises a diaphragm **72*a* to which one end of a rod 70 connected to an ignition timing control movable base of a governor advancing device of the distributor 32 is fixed, an advancing pressure chamber 72*b* sectioned by the diaphragm 72*a* for pulling the rod 70 leftward as viewed in the drawing, and a compression spring 72*c* for biasing the diaphragm 72 rightward as viewed in FIG. 4. The negative pressure pipe 36 is connected to the pressure chamber 72*b* so that the negative pressure advancement is attained. When the exciting coil 64 of the negative pressure switching solenoid valve 24 is not energized, the pressure chamber 72*b* of the negative pressure advancing device 34 is connected to the atmosphere, and when the exciting coil 64 is energized, the pressure chamber 72*b* of the negative pressure advancing device 34 is connected to the advance port 28**.

The operation of the ignition timing control apparatus thus constructed is now explained.

In an idling condition after the start of the engine, the atmospheric pressure upstream of the throttle valve 26 is introduced into the advance port 28 due to a closed position of the throttle valve 26. Under this condition, the atmosphere pressure is introduced into the negative pressure advancing device 34 of the distributor 32 without regard to the position of the negative pressure switching solenoid valve 24 and the ignition timing is not advanced.

In the open position of the throttle valve 26, the intake negative pressure in the vicinity of the throttle valve 26 is introduced into the advance port 28. Under this condition, the ignition timing advancement is controlled in accordance with the position of the negative pressure switching solenoid valve 24. For example, when the temperature signal indicating that the engine coolant temperature is below the predetermined temperature is produced by the coolant temperature switch 6, or when the high speed gear position signal indicating that the gear is at the high speed position is produced by the shift switch 4, or when the light load signal indicating that the negative pressure in the intake manifold 12 is high, that is, the engine is operated in the light load condition is produced by the vacuum switch 14, the exciting coil 64 of the negative pressure switching solenoid valve 24 is energized by the control circuit 20 so that the intake negative pressure taken from the advance port 28 is supplied to the negative pressure advancing device 34 of the distributor 32. As a result, the ignition timing determined by the distributor 32 in accordance with the intake negative pressure leads to the governor advance angle.

In the present embodiment, when at least one of the signals from the shift switch 4, the coolant temperature switch 6 and the vacuum switch 14 is supplied to the control circuit 20, the ignition timing is advanced. Accordingly, when the engine is operated under the light load condition, the vacuum switch 14 produces the light load signal so that the pressure chamber **72*b* of the negative pressure advancing device 34 is connected to the advance port 28 and the ignition timing is advanced in accordance with the magnitude of the intake negative pressure in the vicinity of the throttle valve 26** even if the transmission gear is at other than the high speed gear positon or the engine coolant temperature is above a predetermined temperature. Through this control, when the transmission gear is shifted to other than the high speed gear position after the warm-up of the engine and the engine is operated under the light load condition, the engine output is increased, the drivability of the car is improved and the fuel consumption is reduced to compare with a prior art system in which the ignition timing is not advanced in accordance with the intake negative pressure.

When the throttle valve 26 is fully opened under the high load of the engine, the intake negative pressure is lowered and the negative pressure introduced into the advance port 28 is also reduced. Under this condition, the pressure introduced into the negative pressure advancing device 34 of the distributor 32 is equal to or close to the atmospheric pressure without regard to the position of the negative pressure solenoid valve 24 and the ignition timing is not advanced. Accordingly, only the governor advance control is effective so that the generation of the nitrogen oxide in the exhaust gas is suppressed.

What is claimed is:

1. An ignition timing control apparatus for an internal combustion engine, comprising:

(a) negative pressure advancing means for controlling a governor advancing device arranged at a distributor in accordance with an operation condition of the engine to advance an ignition timing;

(b) gear position sensing means for producing a high speed gear position signal when a transmission gear is at a high speed gear position;

(c) temperature sensing means for producing a temperature signal indicating that the engine is at least in a warm-up condition;

(d) load sensing means for producing a light load signal when the engine is operated under a light load condition; and (e) means for permitting the control to said governor advancing device by said negative pressure advancing means when one of said high speed gear position signal, said temperature signal and said light load signal is produced and inhibiting the control to said governor advancing device by said negative pressure advancing device when none of said high speed gear position signal, said temperature signal and said light load signal is produced.

2. An ignition timing control apparatus for an internal combustion engine, comprising:

(a) negative pressure advancing means for driving a governor advancing device arranged at a distributor in accordance with an intake negative pressure introduced from an advance port formed in a wall of an intake passage slightly upstream of a full close positon of a throttle valve, to advance an ignition timing;

(b) gear position sensing means for producing a high speed gear position signal when a transmission gear is at a high speed gear position;

(c) temperature sensing means for producing temperature signal indicating that the engine is at least in a warm-up conditon;

(d) light load sensing means for producing a light load signal when the engine is operated under a light load condition; and (e) pressure switching means disposed between said advance port and said negative pressure advancing means for introducing the intake negative pressure from said advance port to said negative pressure advancing means when one of said high speed gear position signal, said temperature signal and said light load signal is produced and introducing the atmosphere to said negative pressure advancing means when none of said high speed gear position signal, said temperature signal and said light load signal is produced.

3. An ignition timing control apparatus for an internal combustion engine according to claim 2 wherein said negative pressure advancing means includes a rod connected to said governor advancing device, a diaphragm having said rod fixed thereto, a pressure chamber where the intake negative pressure from said advance port is introduced therein and defined by said diaphragm, and a resilient member for normally biasing said rod toward said governor advancing device through said diaphragm.

4. An ignition timing control apparatus for an internal combustion engine according to claim 2 wherein said presure switching means includes a solenoid switching valve having an air suction port, a first passage for connecting said solenoid switching valve and said advance port, a second passage for connecting said solenoid switching valve and said negative pressure advancing device and a drive control circuit for said solenoid switching valve, said high speed gear position signal, said temperature signal and said light load signal being supplied to said drive control circuit.

5. An ignition timing control apparatus for an internal combustion engine according to claim 2 wherein said load sensing means comprises is a vacuum switch for sensing the intake negative pressure in an intake passage downstream of said throttle valve to produce said light load signal when the sensed intake negative pressure is relatively high due to the light load condition.

6. An ignition timing control apparatus for an internal combustion engine according to claim 2 wherein said temperature sensing means senses a temperature of engine coolant to produce said temperature signal when the temperature of the engine coolant is below a predetemrined temperature.

7. An ignition timing control apparatus for an internal combustion engine, comprising:

(a) negative pressure advancing device having a rod connected to a governor advancing device of a distributor, a diaphragm having said rod fixed thereto, a pressure chamber where the intake negative pressure is introduced therein from an advance port formed in a wall of a intake passage slightly upstream of a full close position of a throttle valve and a spring for normally biasing said rod toward said governor advancing device through said diaphragm, said negative pressure advancing device driving said rod toward said diaphragm in accordance with the magnitude of the intake negative pressure introduced into said pressure chamber to advance an ignition timing;

(b) a shift switch for producing a high speed gear position signal when a transmission gear is at a high speed gear position;

(c) a coolant temperature switch for sensing a temperature of engine coolant and producing a temperature signal when the temperature of the coolant is below a predetermined temperature;

(d) a vacuum switch for sensing an intake negative pressure in an intake passage downstream of said throttle valve and producing a light load signal when the sensed negative pressure is relatively high due to a light load condition; and (e) pressure switching means including a solenoid switching valve having an air suction port, a first passage for connecting said solenoid switching valve and said advance port, a second passage for connecting said solenoid switching valve and said pressure chamber and control device for energizing said solenoid switching valve to communicate said first passage with said second passage when one of said high speed gear position signal, said temperature signal and said light load signal is supplied and deenergizing said solenoid switching valve to communicate said air suction port with said second passage when none of said high speed gear position signal, said temperature signal and said light load signal is supplied.

* * * * *